United States Patent [19]

Noly

[11] 4,149,115

[45] Apr. 10, 1979

[54] WINCHES FOR THE CONTROL OF LIFTING EQUIPMENT OF THE CRANE, OVERHEAD CRANE OR SIMILAR TYPE

[75] Inventor: Jean Noly, La Clakette, France

[73] Assignee: Potain, Chevilly Larue, France

[21] Appl. No.: 779,949

[22] Filed: Mar. 18, 1977

[30] Foreign Application Priority Data

Mar. 18, 1976 [FR] France ..... 76 08601

[51] Int. Cl.[2] ..... B66D 1/50

[52] U.S. Cl. ..... 318/301; 310/95

[58] Field of Search ..... 254/173, 187; 192/2; 310/95; 318/301, 302, 306, 345 R, 360

[56] References Cited

U.S. PATENT DOCUMENTS 3,477,695 11/1969 Noly ..... 310/95

*Primary Examiner*—Herman J. Hohauser

*Attorney, Agent, or Firm*—Remy J. VanOphem

[57] ABSTRACT

The invention is an improved control mechanism for winches as used on cranes and similar devices having a single motor driving the shaft of a winch drum through a pair of eddy current clutches. Gear trains attached to the two clutches are operative to drive the drum's shaft in opposite directions. An electronic control generates an output signal indicative of a commanded speed and direction of drum rotation while a tachometer generates a signal indicative of the actual speed and direction of drum rotation. The electronic control system compares the commanded and actual speed as well as the direction of rotation and generates signals energizing the two clutches. The combined action of the two clutches stabilizes the rotational speed of the drum and its direction of rotation in accordance with the commanded input.

10 Claims, 3 Drawing Figures

WINCHES FOR THE CONTROL OF LIFTING EQUIPMENT OF THE CRANE, OVERHEAD CRANE OR SIMILAR TYPE

CROSS REFERENCE

The winch control mechanism disclosed herein is an improvement over my prior U.S. Pat. No. 3,477,695 issued Nov. 11, 1969 entitled "Lifting Winches." My prior U.S. Pat. No. 3,477,695 identified above is incorporated herein by reference.

BACKGROUND OF THE INVENTION

Field of the Invention

The present invention relates to a winch mechanism for the control of lifting equipment of the type described in the above cross referenced patent, that is to say comprising a rotating drum, the shaft of which is linked to a main drive motor by an electro-magnetic connection system which allows the speed of rotation of the winch to be varied or reversed. My prior U.S. Pat. No. 3,477,695 describes in particular a winch drive mechanism in which the shaft of a winch drum is driven in one direction by a main non-synchronous motor through an eddy current clutch. A smaller auxiliary or overspeed motor is connected to the shaft of the winch drum between the eddy current clutch and the winch drum and is operative to drive the winch drum and in the opposite direction when the clutch is disengaged. When the eddy current clutch is engaged, the overspeed motor is driven in the opposite direction by the main motor. The current of the over speed motor is sensed by an electronic regulator which compares the current signal with a reference signal indicative of a commanded speed and direction of rotation. The electronic regulator generates signal controlling the degree to which the eddy current clutch is energized stabilizing the speed of the winch shaft. In the descent mode, the eddy current clutch is deenergized and the auxiliary or overspeed motor drives the winch shaft in the opposite direction. When an excessive descent speed is sensed, the electronic regulator energizes the eddy current clutch stabilizing the descent rate. This system is suitable for lifting relatively light loads or at relatively low speeds. On the other hand, it is known that the auxiliary motor ensures only the starting operation of the load system during descent. However, it has been established that at the end of a phase of lifting or lowering, the inertia of the load does not immediately immobilize the lifting mechanism when this passes, for example, over a limit security device. In addition, principally for high pressured equipment, the electronic regulator must be connected to electro-magnetic contactors for the power circuits.

Finally, another disadvantage arises from the high cost of the auxiliary motor which, during each operation, must be controlled in the direction of lowering and must process a variable-speed rotor: it is therefore necessary to have a high-slip motor.

The present invention has the aim of remedying these disadvantages and of making an entirely electronic device to control and regulate the direction and speed of rotation of the drum of a lifting winch from a single motor.

SUMMARY OF THE INVENTION

A winch mechanism comprising, a rotating drum of a shaft, a security brake and an electric winch motor, the rotation of the drum of lifting a load being obtained by the relative slipping of two armatures of a main eddy-current clutch, one of the two armatures being keyed to the motor shaft, whilst the other is connected to the drive shaft of a winch transmission system, is characterized in that the motor shaft also carries an auxiliary eddy-current clutch, a tachometric dynamo being permanently connected to the shaft of the drum to read the speed and supply a corresponding signal to one of the inputs of an electronic control system which has another input to which is applied a direct voltage, the polarity of this voltage indicating the required sense of direction of rotation, whilst its size indicates the speed of rotation of the drum required.

According to another characteristic, the electronic control system comprises a potentiometer supplying, through a slider, a reference voltage applied to an input of a differential amplifier reading and amplifying the difference between the signal from the potentiometer and that from the tachometric dynamo, so as to give an output signal which is positive or negative corresponding to the sign of the error.

According to another characteristic, the signal supplied by the potentiometer is negative when it is desired to raise a load, whilst it is positive when it is desired to lower a load.

According to another characteristic, the output signal from the differential amplifier is applied to one or the other of two circuits fitted in parallel, each carrying a diode or a rectification system opposite to each other, and arranged in such a way that when the output signal is positive, it is sent to an energizing circuit of the main motor clutch, whereas if it is negative, it passes through the electronic feed circuit of the auxiliary clutch, each of these two circuits being fitted with a power current amplifier.

According to another characteristic, the auxiliary clutch has a first armature keyed to the motor shaft, whilst its second armature is attached to a train of gears which reverses the direction of rotation, doubles the speed in relation to the motor, (in the lowering direction) and ensures the driving of the tachometric dynamo. The connection between this auxiliary clucth gear train and the driving mechanism of the drum is carried out for example through a universal-jointed transmission. It will be understood that the auxiliary eddy-current clutch and the universal-jointed transmission are an advantageous replacement for the former auxiliary motor of my prior U.S. Pat. No. 3,477,695 whilst the electronic regulation of the speed is carried out by the comparison of the value set by the slider of the potentiometer on the one hand, and the indication supplied by the tachometric dynamo on the other hand.

According to another characteristic, when, during a lifting phase, the current in the main clutch is supressed, the auxiliary clutch is energized, so that a part of the driving torque is reversed and applied through the universal-jointed transmission to the winch drive mechanism. In this way the auxiliary clutch allows the lifting to be slowed by applying torque inverse to the couple of intertia of the parts and loads in upward movement.

The attached drawing, given by way of non-limiting example, will allow the characteristics of the invention to be better understood.

DETAILED DESCRIPTION OF THE PREFERRED EMBODIMENT

Figure 1:
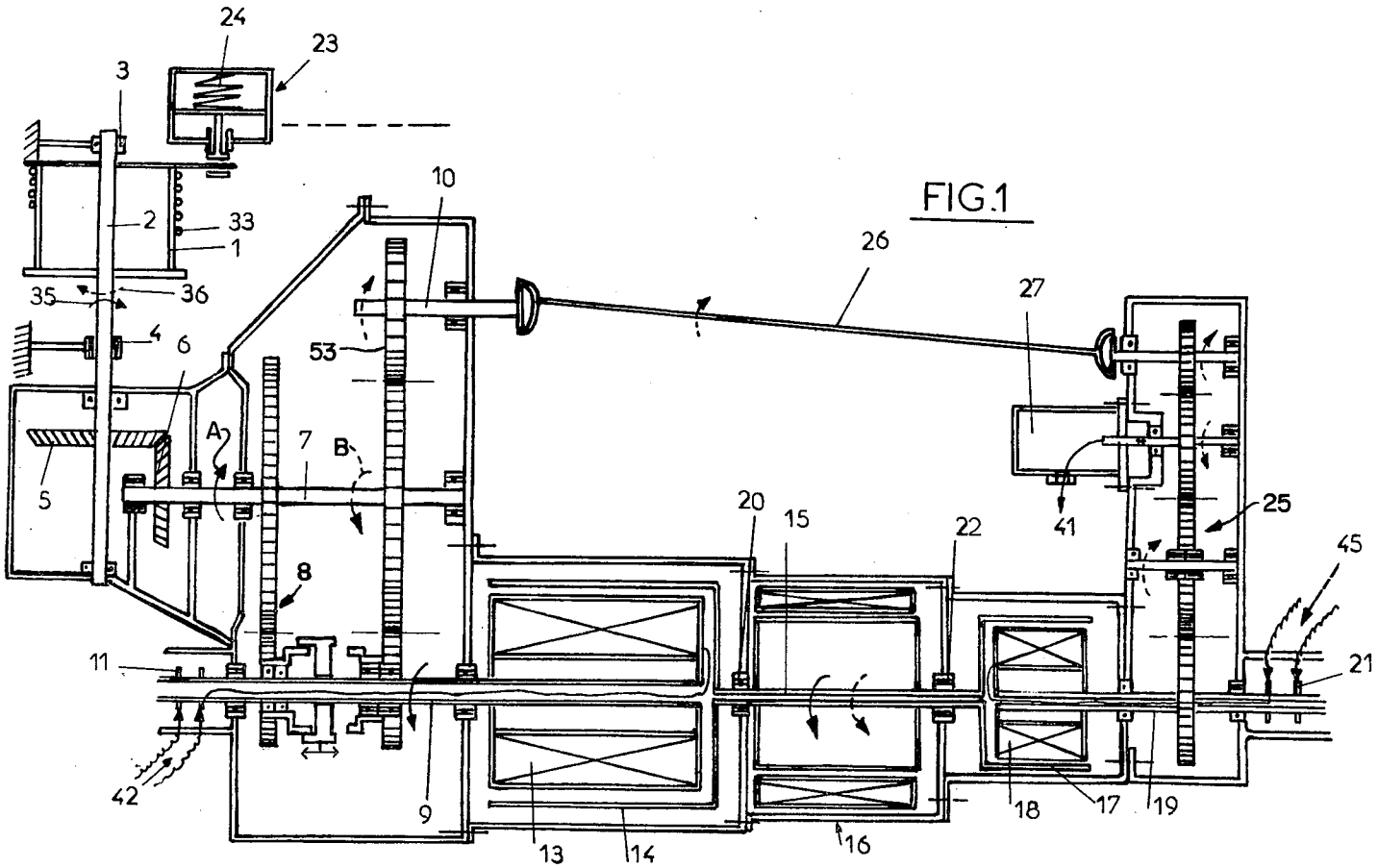
FIG. 1 is a general view in section showing a lifting winch according to the invention.

As already described in my prior patent, the winch comprises a drum 1 keyed to a shaft 2 which revolves in bearings 3 and 4. The shaft 2 is connected to a spiral bevel reduction gear comprising a toothed bevel crown wheel 5 with which engages a pinion 6 carried by the output shaft 7 of a speed reduction gear 8, known as the primary or principal reduction gear. The shaft 7 is connected on the one hand to a shaft 9 and on the other to an auxiliary shaft 10, for example by a transfer gear system 53.

The revolving shaft 9 is attached to the rotor or core armature 13 of a main eddy-current clutch. The core armature 13 turns inside a bell armature 14 which is attached to one end of the shaft 15 of the rotor of an electric motor 16.

The other end of this shaft 15 carries a bell armature 17 of an auxiliary eddy-current clutch. The core armature 18 of this auxiliary clutch is keyed to a revolving shaft 19. The shafts of the main cluctch 13, 14 and the auxiliary clutch 17, 18 are hollow. They carry at their free ends means of electrical contact 11 and 21, by means of which it is possible to energize the core armature 13 or 18, as will be seen later.

The central shaft 15 of the electric motor 16 revolves in bearings 20 and 22 carried by the stator.

In the example illustrated in FIG. 1, the safety brake 23 acts directly on one end-plate of the drum 1. The pressure is mechanical under the action of a coil spring 24, the release being for example hydraulic and controlled at the same time as voltage is applied to the winch motor 16. The shaft 19 of the auxiliary clutch 17, 18 is connected to a gear train forming an auxiliary reduction gear train 25.

The last pinion of the gear train is connected through a universal-jointed transmission 26 to the auxiliary shaft 10 of the main reduction gear train 8. In addition, auxiliary gear train 25 drives a tachometric dynamo 27 which always gives a signal proportionate to the speed of rotation of the drum 1. Finally, auxiliary gear train 25 is designed to reverse the direction of rotation of the drum and double its speed in relation to the motor, that is to say that the engagement of the auxiliary clutch tends to make the drum 1 in the direction which causes the load to be lowered. On the other hand, the engagement of the main clutch 14 makes the drum 1 turn in the direction of the lifting. The solid arrow "A" indicates the direction of rotation of shaft 7 when the main clutch is energized and broken arrow B indicates the direction of rotation of the shaft 7 when the auxiliary clutch is energized.

Figure 2:
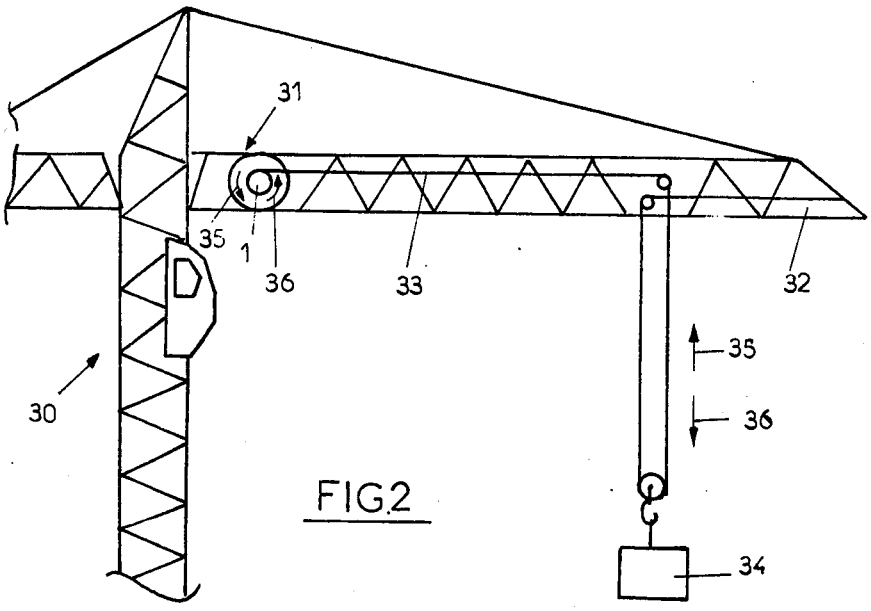
FIG. 2 is a schematic view of a crane showing the path of the load-lifting cable operated by the winch of the invention.

There is shown in FIG. 2 a lifting machine, for example a crane 30 fitted with a winch according to the invention. This winch is for example mounted at 31 at the foot of the jib 32. The rotation of the drum 1 of the winch controls the rolling up or the unrolling of the lifting cable 33 for the load 34. The free end of the cable 33 is, in the known way, anchored to the front of the jib.

Figure 3:
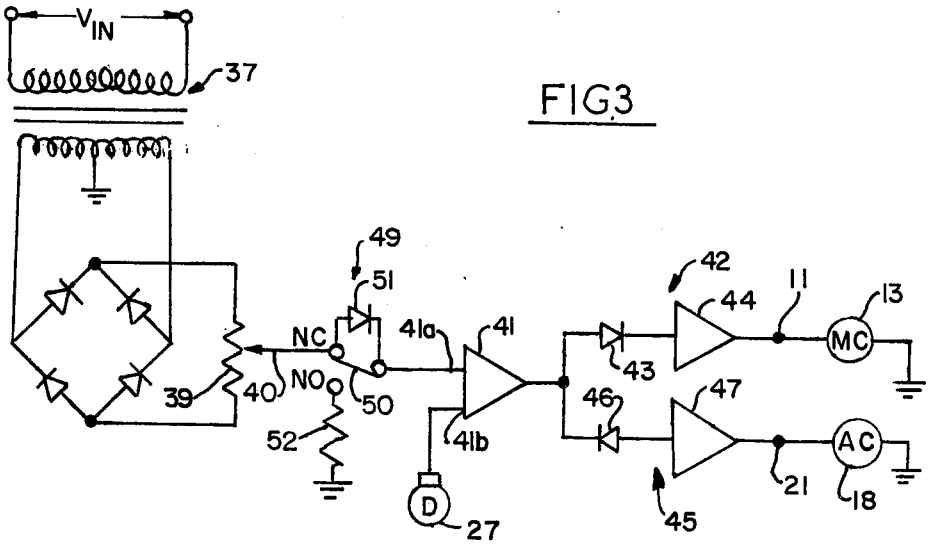
FIG. 3 is a diagram of the electronic energizing circuit of the main and auxiliary eddy-current clutches.

The electronic control system for the control and energizing of the clutches is illustrated in FIG. 3. It comprises:

- a transformer 37 of which the secondary supplies a current which is rectified by a rectifier 38;
- a potentiometer 39 having, for example, a positive terminal, a negative terminal and a central point at zero potential;
- a slider 40 able to be moved along the potentiometer 39 and constitute the control and speed regulating component of the winch;
- a differential amplifier 41 with two inputs, one receiving the signal (positive or negative) transmitted by the slider 40, and the other receiving the signal supplied by the tachometric dynamo 27 corresponding to a given speed and direction of rotation of the winch drum;
- two circuits fitted in parallel to each other at the output of the differential amplifier. The first circuit 42 comprises a rectifying diode 43 allowing only positive signals to pass to a power amplifier 44 of the type taught in my prior U.S. Pat. No. 3,477,695 and incorporated herein by reference or any other type of power amplifier known in the art which supplies an energizing current to the core armature 13 of the main clutch through revolving slip-rings 11; in the second circuit 45 there are successively a rectifying diode 46, only allowing negative signals to pass, a power amplifier 47 of the same type as power amplifier 44 and an energizing circuit through the brushes 21 for the auxiliary clutch 17, 18 and a safety limit device 49 connected between the slider 40 and the input **41*a* of the differential amplifier 41. The safety limit device comprises a safety limit switch 50 having a normally closed contact and a normally open contact; a diode 51 connected in parallel with normally closed contact and a resistance 52** connecting the normally open contact to a ground or zero potential.

The operation is as follows:

It will be seen in FIG. 3 that the enerigizing of the main clutch 13, 14 or the auxiliary clutch 17, 18 is a function of the sign of the output signal supplied by the differential amplifier 41. This sign itself is supplied by the comparison between the signal set by the potentiometer 39 and the signal supplied by the tachometric dynamo which revolves constantly in a fixed relationshiip to the shaft 2 of the drum 1. (FIG. 1).

When it is desired to lift a load, that is to say to roll the cable 33 on to the drum 1, (arrow 35, FIG. 2), the slider 40 is set towards the negative terminal of the potentiometer 39. A negative voltage is then sent to the input **41*a* of the differential amplifier 41. If the drum 1 is at rest, the dynamo supplies the second input 41*b* with a zero signal, that is to say higher than the voltage applied to the input 41*a*. The discrepancy signal at the output from the differential amplifier is positive. It is injected into the circuit 42 through the diode 43, amplified in amplifier 44 to generate the energizing current for the main clucth 13, 14, which sets the winch in rotation in such a way a to roll up the cable 33 and raise the load 34. When the load has been raised to the required height, the normally open contact safety limit switch 50 open and the normally closed contact grounding the input 41*a*. This reverses the polarity of the discrepancy signal and cuts the supply of current to the main clutch, whilst the auxiliary clutch is energized. The auxiliary gear train 25 and the universal-jointed transmission transmit through the clutch 17, 18, a part of the driving torque to the reduction gear train 8**. It has been seen that this torque is opposed to the torque due to the inertia of the moving parts. The winch is gradually slowed and the load becomes stationary. This slowing operation of the lifting is obtained without any mechanical braking component.

When it is desired to start the winch lowering, a voltage above zero is set by the slider 40 and transmitted to input 41*a* through diode 51. If the drum is at rest, the zero voltage supplied by the dynamo 27 is lower than the applied voltage. The discrepancy signal at the output of the differential amplifier is negative. It cannot energize the main clutch but it is amplified in the feed circuit 45 of the auxiliary clutch 17, 18 which transmits a reversed torque to shaft 7 causing the winch to start lowering. In addition, applying voltage to the winch mechanism causes the release of the brake 23. In the case of an accidental loss of electrical power, the electrical release of the mechanical brake is disabled, and the mechanical safety brake automatically stops rotation. When the winch is stopped, the signal at the input 41*b* of the amplifier 41 from dynamo 27 is zero. If a zero voltage is also set at the potentiometer 39 neither the main nor the auxiliary clutch is energized. Supposing that the safety brake 23 is defective, the weight of the lifting system of the load would cause the winch to start to lower through the effect of gravity. Then the tachometric dynamo would supply a signal corresponding to the lowering direction of rotation. It has been seen that this signal is greater than the zero voltage set. The amplifier 41 reads the positive discrepancy and energizes the main clutch which operates to lift.

It has been supposed to explain the operation that the drum was initially at rest (speed of rotation nil). Naturally, the preceding explanation can be generalized for lifting as well as for lowering.

In one direction of lifting, the driving torque is transmitted to the reduction gear by the main clutch, whilst the auxiliary clutch is not energized as long as the set speed is not reached. On the other hand, when the winch has been started to lower, the main clutch is not energized so long as the speed chosen and set at the input to the differential amplifier is not reached.

When this speed is reached or exceeded, as an absolute value, the discrepancy sign at the inputs to differential amplifier 41 is reversed: it becomes positive and the main clutch 13, 14 is energized (in the case of lowering).

The principal advantages of the disclosed winch control mechanism are as follows:

(a) the auxiliary eddy-current clutch carries out two functions, namely the starting of the winch in the direction of rotation of the drum corresponding to the lowering of the load, and the slowing of the raising of this load, this latter function enabling mechanical braking components to be eliminated;

(b) the releasing for lowering no longer requires the starting of an auxiliary motor;

(c) all the regulating and control device is electronic. This is allowed by the fact that only inductors of which the energizing power does not exceed 5% of the power transmitted are used for control;

(d) it is established that a voltage of the order of 1 volt at the output of the differential amplifier is sufficient to saturate the power amplifier of the energizing circuits of the main and auxiliary clutches. Hence the slip of the clutches is stabilised at the chosen speed whatever may be the load suspended on the cable.

In addition, it is understood that the preceding description is given only by way of example. The scope of the invention will not be exceeded by replacing the details of manufacture by any other similar constructions.

For example, if the cases of the reduction gear trains 8 and 25 are perfectly aligned the universal-jointed transmission may be replaced by a simple connection shaft. Similarly, the reduction gear trains shown are of known type and may be replaced by any other known device for speed variation.

Finally, the safety brake may be hydraulically, mechanically or electro-magnetically operated.

What I claim is:

1. A winch mechanism having a rotatable drum, a drum shaft connected to said drum and rotatable therewith, a safety brake operative to stop the rotation of said drum, an electric motor having an output shaft, a main electrically actuated clutch having two armatures, one of said two armatures connected to the shaft of said motor, and a first transmissio system interconnecting the drum shaft with the other armature of the clutch said first transmission system imparting rotation to said drum shaft in one direction, the improvement comprising:

an auxiliary electrically actuated clutch having two armatures, one armature of said auxiliary electrically actuated clutch connected to the shaft of said motor;

a second transmission system interconnecting the other aramature of said auxiliary electrical clutch with said drum shaft, said second transmission system imparting a direction of rotation to the drum shaft the reverse of said one direction imparted to the drum shaft by said first transmission system;

a sensor connected to said drum shaft to generate an electrical signal having a polarity indicative of the rotational direction of the drum and a magnitude inidicative of said drum speed of rotation;

control means receiving a manual input indicative of a commanded direction of rotation and a commanded speed, and the electrical signal generated by said sensor, for generating electrical signals energizing said main and said auxiliary electrically actuated clutches to rotate said drum in the direction of rotation and the speed commanded by the received manual input.

2. A winch system according to claim 1 wherein said control means comprises:

a potentiometer having a manually movable slider, said potentiometer providing through said slider a reference signal, the polarity of which is indicative of the commanded direction of rotation, and the magnitude of which is indicative of the commanded speed;

amplifier means for energizing said main electrically actuated clutch in response to said reference signal having a first polarity with respect to the signal generated by said sensor and for energizing said auxiliary electrically actuated clutch in response to said reference signal having an opposite polarity with respect to the signal generated by said sensor the degree of energization of said main and said auxiliary clutches being a function of magnitude of the difference between said reference signal and the magnitude of the signal generated by said sensor.

3. A winch system according to claim 2 wherein said first polarity is a negative electrical potential when it is desired to rotate the drum in a direction to lift a load and wherein said opposite polarity is a positive electrical potential when it is desired to rotate the drum in a direction to lower a load.

4. A winch system according to claim 2 wherein said amplifier means comprises:

a differential amplifier receiving said reference signal at a first input and the signal generated by said sensor at a second input said differential amplifier generating an output signal having a polarity opposite the polarity difference between the signal generated by said sensor and said reference signal and magnitude proportional to the difference in the magnitude of the reference signal and the signal generated by the sensor;

first amplifier means for generating an output current energizing said main clutch in response to signals of the first polarity inverted at the output of said differential amplifier; and second amplifier means for generating an output current energizing said auxiliary clutch in response to signals of the opposite polarity inverted at the output of said differential amplifier.

5. A winch system according to claim 4 wherein said first amplifier means includes a first diode, passing the inverted signals of the first polarity and blocking the inverted signals of the opposite polarity, and said second amplifier includes a second diode blocking the inverted signals of the first polarity and passing the inverted signals of the opposite polarity.

6. A winch system according to claim 1 wherein said second transmission system is operative to rotate the drum in the reverse direction at twice the speed of said first transmission system.

7. A winch system of claim 1 wherein said first and second transmission systems are a main and auxiliary gear train respectively and wherein said sensor is a tachometer dynamo driven by said auxiliary gear train.

8. A winch system of claim 7 wherein said auxiliary gear train includes a universal jointed member connecting said auxiliary gear train to said main gear train.

9. A winch system according to claim 1 further including a limit switch actuated at the end of the lifting phase, said limit switch cutting and energizing said auxiliary clutch to apply a reverse torque to the drum opposing the inertia of the components of the system in the lifting direction.

10. A winch system according to claim 1 wherein said main and auxiliary clutches are eddy current clutches.

* * * * *

UNITED STATES PATENT AND TRADEMARK OFFICE

CERTIFICATE OF CORRECTION

PATENT NO. : 4,149,115

DATED : April 10, 1979

INVENTOR(S) : Jean Noly

It is certified that error appears in the above-identified patent and that said Letters Patent are hereby corrected as shown below:

Column 1, line 9, please delete "entitled "Lifting Winches." My" and insert therefore ----entitled "Lifting Winches". My----

Column 1, line 33, please delete "over speed" and insert therefore ----overspeed----.

Column 2, line 52, after the number 3,477,695 insert a ---- , -----.

Column 3, line 32, please delete the word "cluctch" and insert therefore the word ----clutch----.

Column 3, line 56, after the number "1" please insert the word ----turn----.

Column 4, line 38, after the word"contact", second occurrence, please delete ";" and insert therefore ---- , ----.

UNITED STATES PATENT AND TRADEMARK OFFICE

CERTIFICATE OF CORRECTION

PATENT NO. : 4,149,115

DATED : April 10, 1979

INVENTOR(S) : Jean Noly

It is certified that error appears in the above-identified patent and that said Letters Patent are hereby corrected as shown below:

Column 4, line 59, please delete the word "the", first occurrence.

Column 4, line 66, after the word "contact" please insert the word ----of----.

Column 4, line 67, "after "contact" insert -- closes --.

Column 5, line 12, please delete the word "set" and insert therefore the word ----applied----.

Column 5, line 41, please delete the word "one" and insert therefore the word ----the----.

UNITED STATES PATENT AND TRADEMARK OFFICE

CERTIFICATE OF CORRECTION

PATENT NO. : 4,149,115

DATED : April 10, 1979

INVENTOR(S) : Jean Noly

It is certified that error appears in the above-identified patent and that said Letters Patent are hereby corrected as shown below:

Column 6, line 25, please delete the word "transmissio" and insert therefore the word ----transmission----.

Signed and Sealed this

*Fourth* Day of *September 1979*

[SEAL]

*Attest:*

*Attesting Officer*

LUTRELLE F. PARKER

*Acting Commissioner of Patents and Trademarks*